US005662510A

United States Patent [19]

Wolens

[11] Patent Number: 5,662,510

[45] Date of Patent: Sep. 2, 1997

[54] BALLOON ANCHOR WITH SOUNDER AND DISPLAY AREA

[75] Inventor: John Wolens, Glencoe, Ill.

[73] Assignee: 24th and Dean, Inc., Chicago, Ill.

[21] Appl. No.: 618,961

[22] Filed: Mar. 20, 1996

[51] Int. Cl.[6] ..... A63H 5/00; A63H 3/06

[52] U.S. Cl. ..... 446/397; 446/220; 446/404; 40/455

[58] Field of Search ..... 40/455, 717; 446/397, 446/220, 484, 485, 494

[56] References Cited

U.S. PATENT DOCUMENTS

| | | | |
|---|---|---|---|
| 4,222,188 | 9/1980 | Tarrant et al. | 40/455 X |
| 4,531,310 | 7/1985 | Acson et al. | 40/455 X |
| 4,638,207 | 1/1987 | Radice | 446/397 X |
| 4,704,934 | 11/1987 | Nosrati | 446/220 X |
| 5,137,488 | 8/1992 | Yeh | 446/397 |
| 5,444,607 | 8/1995 | Dreyfuss | 446/220 X |

FOREIGN PATENT DOCUMENTS

| | | | |
|---|---|---|---|
| 1063722 | 12/1953 | France | 446/220 |
| 403045989 | 2/1991 | Japan | 40/455 |
| 406165883 | 6/1994 | Japan | 446/397 |
| 2155858 | 10/1985 | United Kingdom | 40/455 |

*Primary Examiner*—Robert A. Hafer
*Assistant Examiner*—D. Neal Muir
*Attorney, Agent, or Firm*—Niro, Scavone, Haller & Niro

[57] ABSTRACT

The present invention relates to a novelty device for use in connection with inflatable balloons. The device includes a housing that has been adapted to be affixed to a balloon and which provides a graphical display portion. The housing also contains a sound emitting device that is capable of either playing a preselected musical composition or recorded message.

6 Claims, 1 Drawing Sheet

BALLOON ANCHOR WITH SOUNDER AND DISPLAY AREA

BACKGROUND OF THE INVENTION

The present invention relates generally to a novelty apparatus, and more particularly, to a balloon weight that provides both a graphical presentation or message as well as an audio presentation or message. The device includes a housing that has been adapted to be affixed to a balloon. The housing provides a graphical display portion and also contains a sound emitting device that is capable of either playing a preselected musical composition or a recorded message.

SUMMARY OF THE INVENTION

The purpose of this invention is to provide a device that increases the advertising and novelty appeal of a typical inflatable balloon. In the past, inflatable balloons have been used as novelty devices that impart both a colorful presentation as well as limited graphical presentation through the use of some form of printing upon the balloon itself. However, the appeal of such a device is limited to the subject matter printed upon the balloon. Moreover, with ever increasing environmental concerns, it is also desirable to have a device in which an inflated balloon, such as a helium balloon, is prevented from inadvertent release into the environment.

The present invention enhances the appeal of an inflatable balloon by providing a housing that provides for the use of additional visual graphics as well as a sound emitting device that adds an audio dimension to the entire product. Lastly, because the housing is adapted to be attached to the balloon, the device may be weighed to prevent the inadvertent release of a single inflated balloon or multiple balloons.

Accordingly, an object of the present invention is to provide a device which increases an inflatable balloon's visual graphics.

Another object of the present invention is to provide a device which adds an audio capability to an inflatable balloon.

Another object of the present invention is to provide a device which prevents the inadvertent release of an inflated balloon.

BRIEF DESCRIPTION OF THE DRAWINGS

These and other features, objects and advantages of the present invention will become apparent from the following description and drawings wherein like reference numerals represent like elements in the several views, and in which.

DETAILED DESCRIPTION OF THE PREFERRED EMBODIMENTS

Figure 1:
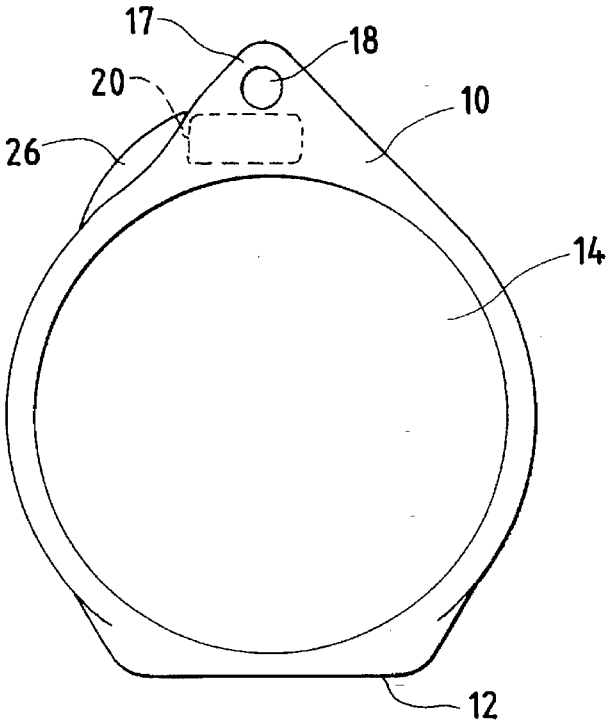
FIG. 1 is a front view of one embodiment of the present invention.
Figure 2:
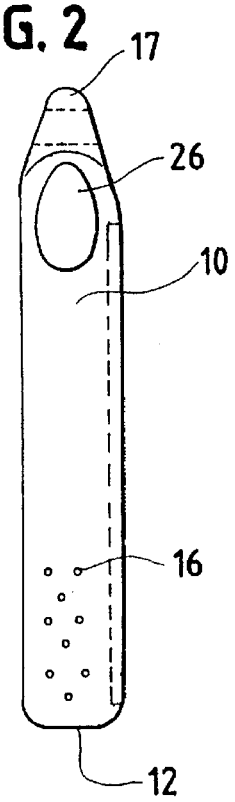
FIG. 2 is a side view of the embodiment shown in FIG. 1.
Figure 3:
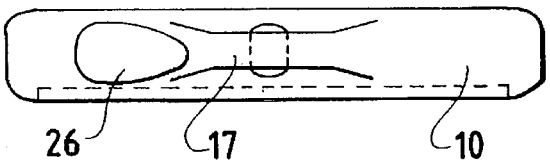
FIG. 3 is a top view of the embodiment shown in FIG. 1.

In accordance with a preferred embodiment of the present invention, the novelty device, such as that shown in FIGS. 1 and 2, consists of a housing 10 having a flat bottom surface 12, graphic display portion 14, speaker holes 16, and attachment aperture 18. In configuring housing 10, it is preferable for the housing to be constructed from two halves such that a smooth and substantially enclosed structure is formed. Doing so limits the amount of small, breakable parts used in the housing. This is important since small children will find the device attractive and appealing.

The sound emitting device 20 (shown as broken lines) is contained in housing 10 and may be either secured through the use of adhesives, sonic welding or in other ways known to those of skill in the art. The sound emitting device 20 used in the illustrated embodiment of the present invention may be a sound generating microchip device, for example, but not limited to a Sound Generator model HT-2812 1 produced by Holtek Microelectronics Inc. of Taiwan R.O.C. Such microchip devices may be configured to produce a variety of sounds or messages, such as a telephone ringing, business jingles, voice messages, speech, sound effects, musical melodies, tones or the like.

Connected to sound emitting device 20 is a user activated switch 26 that may be a pushbutton, a switch or like. Switch 26 activates sound emitting device 20. Activation causes audio signals, such as sounds, voice messages, speech, sound effects, musical melodies, tones or the like, to be generated for a predetermined period of time (i.e. 10 seconds or the like).

Speaker holes 16 located at the bottom of portion of the device allow for the transmission of the audio component and surface 12 allows the device to be placed upon a flat object. When attaching the balloon to housing 10, the balloon may be either tied directly to housing 10 at aperture 18 or suspended above the device by tying a piece of string to aperture 18 and to the balloon.

It should also be noted that other tie-down structures may also be used to secure a balloon. These structures may include a shank, post, clip, or some other design which permits the affixment of the balloon.

Since the impact and appeal of device depends in part upon a visual component, the area comprising display portion 14 should be of sufficient size to permit the incorporation of text or graphics which are large enough to be clearly visible. At the same time, the device must also present an aesthetically pleasing appearance and still be capable of performing the functions of free standing operation through the use of flat surface 12, attachment to a balloon through aperture 18, or both.

It has been found that a truncated tear-drop shaped housing, as shown in FIG. 1, is one of several possible shapes that satisfies these requirements by maximizing the amount of surface area available for use to form graphic display 14 while minimizing the amount of area needed to perform the device's other functions. For example, this shape forms an apex 17 at the top of the housing in which aperture 18 may be located and which economizes the area used while still allowing for easy access to the aperture. The tear-drop shape also allows switch 26 to be located near the top of the device and it further provides a housing that has enough surface area at surface 12 for the free standing operation of the device. Moreover, having additional surface area at the bottom of the device provides a convenient area in which to locate speaker holes 16 in a position where their visibility is diminished. Lastly, the tear-drop shape provides a generous amount of surface area which may used for the display of graphics. Not only does this shape provide a dual sided (front and back) presentation, it also is of sufficient size for the clear display of graphics. To further accentuate the visual component, display area 12 may be either recessed or an extended portion and further incorporate a lighting means for the illumination of the graphics. It will also be understood by those of ordinary skill in the art that other shapes which also are capable of forming a graphic display portion that comprises a substantial amount of the surface area of the housing would also be within the scope of my invention.

In use, a visual impression is first made by the device through the balloon it self and through the media incorporated onto graphic display portion 14. Graphic display portion 14 may be used to convey a slogan, corporate message, or even contain a personalized photograph of the gift's recipient. An audio impression is then made through the activation of switch 26 and should enhance or accompany the visual message or impression. For example, the audio portion may be programmed to play a personalized message using the recipient's name. The sound emitting means may also be programmed to play a fanciful tune or a partial rendition of a well known musical work such as Happy Birthday.

While the preferred embodiments of the present invention have been illustrated and described, it will be understood by those of ordinary skill in the art that changes and other modifications can be made without departing from the invention in its broader aspects.

What is claimed is:

1. A musical balloon weight for use in connection with an inflatable balloon comprising:

a housing having top and bottom portions and constructed of first and second halves which are joined together to form a substantially smooth and enclosed surface having an interior space;

said first and second halves of said housing having increased surface areas forming graphic display portions for the display of visual material;

at least one speaker hole located in said housing for the transmission of sound;

a flat surface located at the bottom portion of said housing and adapted to provide a support surface that allows for the upright and free standing operation of said device;

a tie-down located at the top portion of said housing, said tie-down is adapted to securingly retain an inflatable balloon;

a means for emitting a sound incorporated into said interior space of said housing; and an activatable switch located on said housing, said switch in communication with and controls the activation of said sound emitting means.

2. The device of claim 1 wherein said housing further includes an apex formed at the top portion of said housing, said apex further containing an aperture for securely retaining said inflatable balloon.

3. The device of claim 1 wherein said housing is tear-drop shaped.

4. The device of claim 1 wherein said housing including a weighed portion.

5. The device of claim 1 wherein said graphic display portions are recessed.

6. The device of claim 1 wherein said graphic display portions form extended portions.

* * * * *